United States Patent [19]

Ebeling

[11] Patent Number: 4,652,365

[45] Date of Patent: Mar. 24, 1987

[54] WASTE SCREEN

[75] Inventor: Olavi Ebeling, Helsinki, Finland

[73] Assignees: Oy Kontekla, Helsinki, Finland; Aeromator Trading Company AB, Stockholm, Sweden

[21] Appl. No.: 691,194

[22] PCT Filed: Apr. 13, 1984

[86] PCT No.: PCT/SE84/00139

§ 371 Date: Dec. 6, 1984

§ 102(e) Date: Dec. 6, 1984

[87] PCT Pub. No.: WO84/04126

PCT Pub. Date: Oct. 25, 1984

[30] Foreign Application Priority Data

Apr. 14, 1983 [SE] Sweden ..... 8302082

[51] Int. Cl.[4] ..... B01D 35/02

[52] U.S. Cl. ..... 210/163; 210/166; 52/12

[58] Field of Search ..... 210/163, 164, 165, 166; 52/11, 12, 14, 15, 199, 302

[56] References Cited

U.S. PATENT DOCUMENTS

| | | | |
|---|---|---|---|
| 1,791,512 | 2/1931 | Schurman | 210/163 |
| 2,328,315 | 8/1943 | Warren | 210/165 |
| 2,519,843 | 8/1950 | Matheis | 210/165 |
| 2,837,212 | 6/1958 | Schmid | 210/165 |
| 3,321,080 | 5/1967 | Pansini et al. | 210/163 |
| 3,357,561 | 12/1967 | Schmid et al. | 210/163 |
| 3,378,858 | 4/1968 | Jacuzzi | 210/163 |
| 3,469,698 | 9/1969 | Blendermann | 52/12 |
| 3,469,699 | 9/1969 | Blendermann et al. | 210/166 |
| 3,517,813 | 6/1970 | Thaler | 210/166 |
| 3,893,919 | 7/1975 | Flegel et al. | 210/166 |
| 4,107,929 | 8/1978 | Ebeling et al. | 52/12 |
| 4,112,691 | 9/1978 | Ebeling et al. | 52/12 |
| 4,400,272 | 8/1983 | Logsdon | 210/166 |
| 4,508,814 | 3/1985 | Marshall | 210/166 |

FOREIGN PATENT DOCUMENTS 327806 8/1970 Sweden .

*Primary Examiner*—Richard V. Fisher
*Assistant Examiner*—Wanda L. Millard
*Attorney, Agent, or Firm*—Holman & Stern

[57] ABSTRACT

A waste screen for roof drainage outlet located substantially in the plane of the roof consists of an outlet opening in the roof and a plate covering the opening having a circumference and vertical distance from the roof plane so that at least at dimensioning flow amount air is prevented from being sucked in beneath the plate edge and the gap between the plate and roof plane constitutes the outlet port. The water on its passage from the pitch to the outlet opening always passes through the outlet port, which ensures that in dimensioning cases the outlet opening and subsequent pipe are entirely filled with water. A screen extends about the circumference of the plate (4) and comprises a screen wall (7), which extends from the roof plane (1) to a plane above the plane through the circumference (circumferential edge) of the plate (4). A flow-through wall (11) extends from here to an upper annular surface where walls (7) and (11) are joined along their upper regions which constitutes an overflow edge radially inward of the upper surface of the plate (4).

9 Claims, 2 Drawing Figures

WASTE SCREEN

CROSS REFERENCE TO RELATED APPLICATION(S)

This United States application stems from PCT International Application No. PCT/SE84/00139 filed Apr. 13, 1984.

BACKGROUND OF THE INVENTION

1. Field of the Invention

This invention relates to a waste screen for a roof drainage outlet, which is located substantially in the roof plane and consists of an outlet opening in the roof and a plate covering said opening, which plate has such a circumference and vertical distance above the roof plane, that at least at the design flow rate air is prevented from being sucked in beneath the plate edge, and the gap between the plate and roof plane, thus, constitutes the outlet port.

2. Description of the Prior Art

Waste screens for roof drainage outlets are known in various different designs. The simplest type consists of a perforated plate laid above the outflow opening. One requirement, however, is that there must be an outlet through the opening even when the screen is clogged, and that such outlet must comprise a so-called overflow outlet. Screens for roof discharge pipes, therefore, often are designed as cylinders with perforated casing surfaces, and the upper edge of the casing constitutes the overflow edge. This implies that in the a clogged casing surface the water rises and flows over the upper edge of the casing and through the interior of the casing without being screened.

BRIEF SUMMARY OF THE INVENTION

The present waste screen according to the invention is intended to be used as a special roof drainage device, which consists of an opening and a plate as referred to above, and which acts in such a manner, that air cannot be sucked in beneath the plate and, thus, turbulence cannot arise in the outlet. Such turbulence would render it impossible to utilize the entire opening of the outlet, but would cause the water to rotate in the opening and thereby form a cavity centrally in the opening, which cavity would be propagated downward in the outlet after the outlet opening.

A special object of the present invention is to ensure that the water on its passage from the pitch to the outlet opening always passes through the outlet port, which ensures that the filling capacity for the outlet opening and, thus, the outlet is one, i.e. the outlet opening and subsequent pipe are entirely filled with water.

For achieving the aforesaid objects, the invention is characterized in that the screen extends about the circumference of the plate and comprises a screen wall, which extends from the roof plane to a plane above the roof plane through the circumference (circumferential edge) of the plate and comprises a through-flow wall extending from here to the upper surface of the plate. which walls are joined along their upper edges which, thus, constitute an overflow edge inward to the upper surface of the plate, when the screen wall does not permit arriving flow to pass through, owing to reduced passage capacity of the screen wall. The waste screen thereby ensures that inflow to the outlet opening always takes place through the outlet port.

BRIEF DESCRIPTION OF THE DRAWINGS

An embodiment of the invention will now be described in detail with reference to the accompanying drawings, wherein.

DETAILED DESCRIPTION

Figure 1:
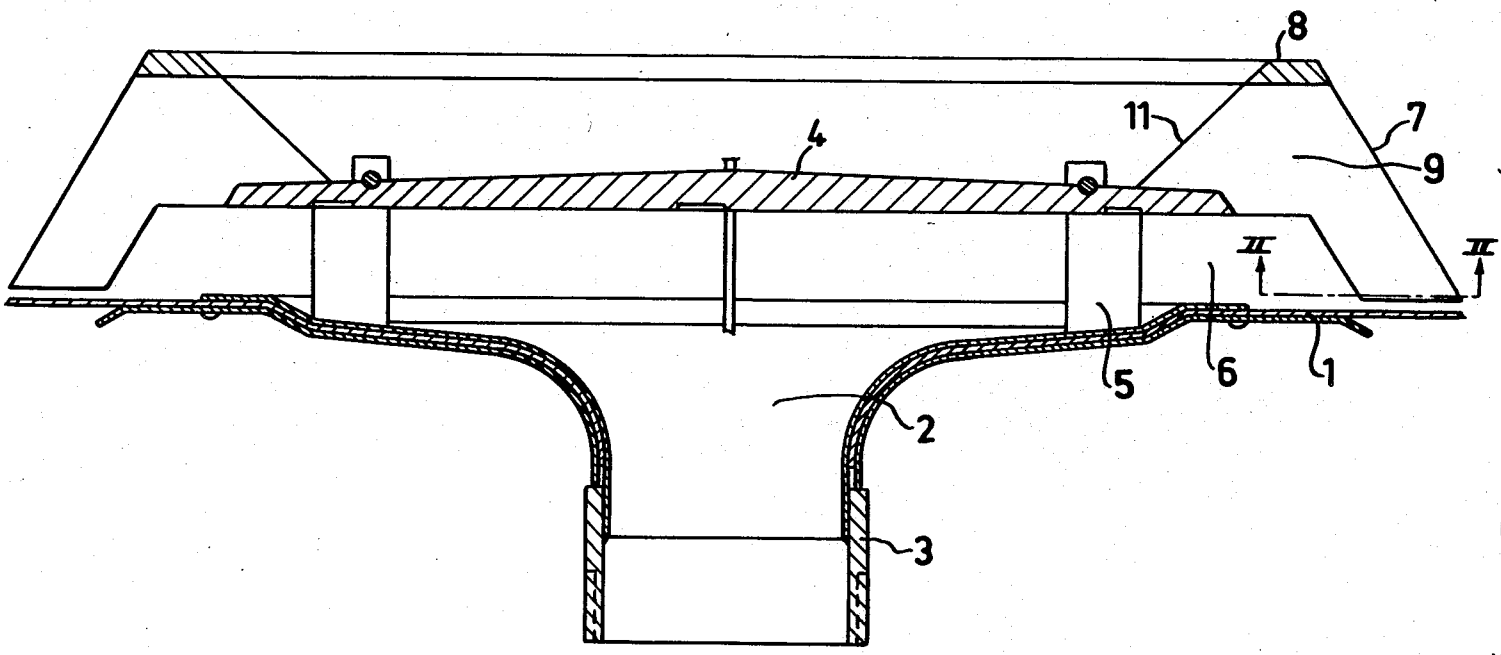
FIG. 1 is a cross-sectional veiw through the waste screen according to the invention, which screen is provided together with a roof drainage device

In FIG. 1 the numeral 1 designates a roof plane, which may be entirely horizontal or inclined. The roof plane 1 includes an opening 2, which according to the drawing is formed with streamlined walls and transforms to an outlet pipe 3. The opening is covered by a plate 4 in the form of a disc spaced upward from the roof plane 1. The distance of the plate is calculated so that at the designed amount of effluent water air is not sucked in beneath the plate, thereby preventing turbulence from arising in the outflow opening 2, which turbulence would cause air to be sucked downward and prevent the pipe 3 form being entirely filled with water. The plate 4, instead, ensures that at the designed amount of rain water the pipe 3 and opening 2 are filled entirely with water, i.e. the filling degree is one. As an example can be mentioned, that the distance of the plate 4 to the roof plane 1 can be 20 mm. A further essential factor is the size of the circumference of the plate, which in a preferred embodiment is circular. The plate 4 is maintained suitably spaced from the roof plane 1 by means of clips 5.

Figure 2:
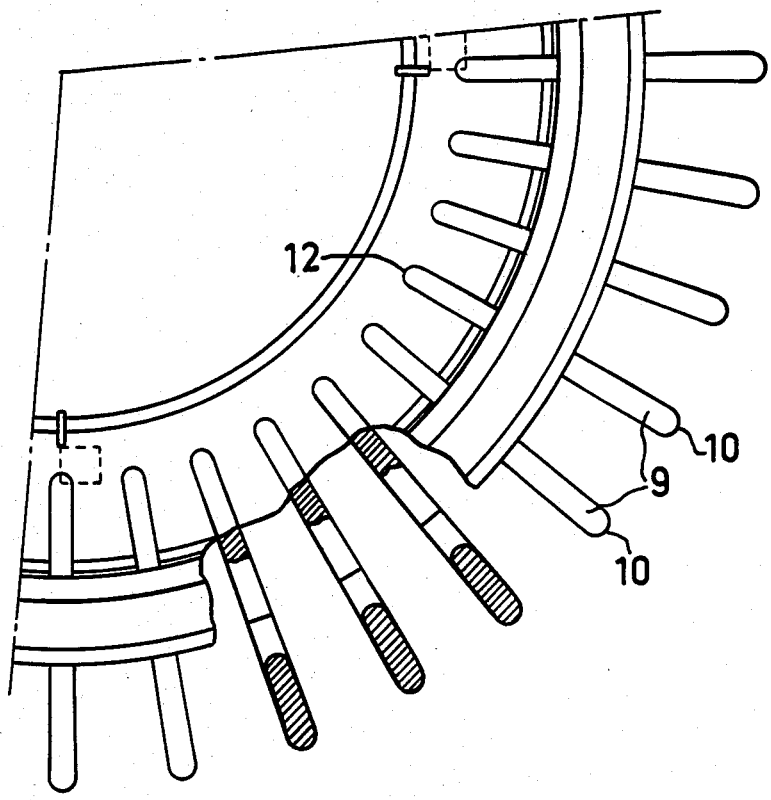
FIG. 2 is a portion of a top plan view showing a partial cross-section taken along the line II—II in FIG. 1.

A waste screen always must be provided before an outlet opening. In the present case the waste screen is located before the gap formed between the plate 4 and roof plane 1 and constituting the outlet port 6. The waste screen consists of a screen wall 7, which extends from a roof plane 1 to a certain level above the plate 4. In the embodiment shown, the screen wall terminates at an annular plane 8. The screen wall is inclined obliquely downward and outward to the roof plane 1 relative to the plate 4. The screen wall consists of a plurality of flanges 9, see FIG. 2, which are arranged in radial direction relative to the plate 4, to which they are attached. It is the outer edges 10 of the flanges 9 which form screen walls, and which preferably are streamlined in order to yield the lowest possible flow resistance. The flanges, thus, are arranged to the side of each other in equally spaced relationship about the plate 4, and the distance between the flanges 9 determines the flow capacity of the screen wall 7. In order that there should be some relationship with the dimensioned outlet port so that the filling degree for the outlet opening is one, the flow capacity for the screen plate 7 at dimensioning water amount must be at least equal to the flow capacity of the outlet port. The screen wall 7 shall separate coarse impurities, which are not permitted to flow downward through the outlet opening 2. When the screen wall 7 is clogged, the water level on the roof rises and causes overflow over the annular surface 8.

The overflow water, which now will be directed again to the outlet port 6, is passed through a flow-through surface 11. The water flows through this surface down to the roof plane 1 and in through the outlet port 6. The flow-through surface 11, therefore, must have a flow capacity corresponding at least to the flow capacity for the outlet port 6. In the embodiment shown, the flow surface 11 is formed by the second or inner edges 12 of the flanges 9. These edges 12 preferably are also streamlined. In order to ensure the function of overflow over the plane 8, the smallest flow area measured from the flow-through surface 11 to the outlet port 6 must have such a size, that the flow resistance is the smallest possible in relation to that of the outlet port. It is, in fact, not sufficient that the flow areas shall have a certain ratio, but what is to be talked about is the flow capacity, because frictional forces from the sides of the flanges 9 must also be taken into account. It is to be emphasized, however, that the flow surface 11 only exceptionally is to be caused to work, and normally the water shall flow through the screen surface 7 to the outlet port 6 for further transport through the opening 2 and pipe 3.

The screen possibly can be protected by an additional screen surface, which in such a case is laid in the same plane as the annular surface 8. Said additional screen is intended to prevent the plate 4 from collecting leaves and the like inside of the annular plane 8 and, thus, the annular screen.

One embodiment of the invention has been described above, but variations thereof can be imagined. In one such imaginable embodiment, the screen surface 7 can be designed as a perforated wall, which is positioned inclined in front of the outlet port 6 and at its upper edge is joined to a second perforated wall extending obliquely inward and joining the plate 4. The inclination shown for the wall 7 and flow-through wall 11 are not critical, but can be varied.

I claim:

1. In a waste screen for a roof drainage outlet for draining water from a roof, the outlet being located substantially in the plane of the roof and having means defining an outlet opening in the roof for effluent water and a plate having a contour shape and extending over the opening wherein the circumference and distance of the plate vertically above the roof plane are such that the gap between the plate and roof plane constitutes the outlet port of the waste screen, the improvement wherein:

the plate is substantially solid and substantially disc-shaped and the circumference and distance of the plate above the roof plane are predetermined to produce a desired flow capacity and flow rate of the outlet port to at least at the desired flow rate prevent air from being drawn in beneath the edge of the plate; and a screen is disposed around the circumference of the plate comprising an outer screen wall extending from the roof plane through and above a plane containing the circumferential edge of the plate, said outer screen wall having an effluent flow capacity, and an inner flow-through wall extending upwardly from said plane containing said circumferential edge and joined with said outer screen wall to form an overflow edge at upper regions of said outer screen wall and inner flow-through wall in a plane above said plate and extending inwardly with respect to said circumferential edge of said plate, so that when the effluent flow capacity of said outer screen wall is reduced due to blocking thereof said inner flow-through wall ensures that effluent flowing over said overflow edge flows through the outlet port to the outlet opening.

2. A waste screen as claimed in claim 1 wherein:

said overflow edge comprises a planar overflow member extending between the upper regions of said outer screen wall and inner flow-through wall and having a contour shape corresponding to the contour shape of the plate.

3. A waste screen as claimed in claim 2 wherein:

the plate is substantially circular; and said overflow member comprises an annular member coaxially disposed with respect to the plate.

4. A waste screen as claimed in claim 1 and further comprising:

a plurality of flanges having surfaces extending in substantially equally spaced relationship about the circumference of the plate and in a direction substantially parallel to the flow of effluent water from outside the screen to the outlet opening in the roof; and streamlined outer edges on said flanges forming said screen wall.

5. A waste screen as claimed in claim 1 wherein:

said flow-through wall has a flow capacity at least equal to the flow capacity of the outlet port.

6. A waste screen as claimed in claim 4 wherein:

the plate is substantially circular; and said overflow member comprises an annular member coaxially disposed with respect to the plate.

7. A waste screen as claimed in claim 4 and further comprising:

streamlined inner edges on said flanges forming said flow-through wall.

8. A waste screen as claimed in claim 7 wherein:

the plate is circular;

said overflow member comprises an annular member coaxially disposed with respect to the plate and connected to said flanges at the upper regions thereof; and said flanges comprise substantially planar members extending substantially radially with respect to the central axis of the plate.

9. A waste screen as claimed in claim 8 wherein:

said streamlined edges of each of said flanges converge toward each other from the lower region below said plate to the upper region thereof.

* * * * *